US006729686B2

(12) United States Patent
May

(10) Patent No.: US 6,729,686 B2
(45) Date of Patent: May 4, 2004

(54) CHAIR AND RECLINER MECHANISM

(75) Inventor: Teddy J May, Tupelo, MS (US)

(73) Assignee: Lane Furniture Industries, Inc., Tupelo, MS (US)

( * ) Notice: Subject to any disclaimer, the term of this patent is extended or adjusted under 35 U.S.C. 154(b) by 67 days.

(21) Appl. No.: 09/960,476

(22) Filed: Sep. 24, 2001

(65) Prior Publication Data

US 2003/0057742 A1 Mar. 27, 2003

(51) Int. Cl.[7] ..... A47C 1/02
(52) U.S. Cl. ..... 297/84; 297/85
(58) Field of Search ..... 297/68, 85, 84

(56) References Cited

U.S. PATENT DOCUMENTS

| | | | |
|---|---|---|---|
| 3,069,201 | A | 12/1962 | Belisle et al. |
| 3,462,190 | A | 8/1969 | Campbell |
| 3,550,952 | A | 12/1970 | Ferguson |
| 3,622,198 | A | 11/1971 | Re |
| 4,147,336 | A | 4/1979 | Yamawaki et al. |
| 4,247,146 | A | 1/1981 | Cycowicz et al. |
| 4,367,895 | A | 1/1983 | Pacitti et al. |
| 4,662,673 | A | 5/1987 | Crum |
| 4,904,019 | A | 2/1990 | May |
| 4,989,914 | A | 2/1991 | Pine |
| 5,072,988 | A | 12/1991 | Plunk |
| 5,141,284 | A | 8/1992 | LaPointe |
| 5,156,441 | A | 10/1992 | Byersmith et al. |
| 5,217,276 | A | 6/1993 | LaPointe et al. |
| 5,346,285 | A | 9/1994 | West, III |
| 5,360,255 | A | 11/1994 | Cook et al. |
| 5,427,431 | A | 6/1995 | Saul et al. |
| 5,480,209 | A | 1/1996 | May |
| 5,527,092 | A | 6/1996 | Cook et al. |
| 5,800,010 | A | 9/1998 | May |
| 6,142,558 | A | 11/2000 | May |

*Primary Examiner*—Anthony D. Barfield
(74) *Attorney, Agent, or Firm*—Pillsbury Winthrop, LLP

(57) ABSTRACT

A mechanism for a reclining chair is caused to be more stable and to have enhanced ease of use. The mechanism includes strut supports extending obliquely forwardly and upwardly from pivotal connections to the base to a set of links connected to the operating handle torque tube at the left and right sides. By preference, the strut supports are connected to the base intermediate forward support links and rearward support links.

11 Claims, 9 Drawing Sheets

CHAIR AND RECLINER MECHANISM

BACKGROUND OF THE INVENTION

The present invention relates to a chair and a reclining mechanism therefor, and especially to a reclining chair and mechanism which is particularly useful in providing an article of motion seating furniture that has enhanced stability, ease of operation, and which provides greater comfort for users.

Existing designs for reclining chairs, such as the chair disclosed in U.S. Pat. No. 5,800,010, provide a high degree of comfort and can accommodate persons who are significantly taller and heavier than the average adult human. However, a need exists for reclining chairs and other motion seating furniture (e.g., free-standing reclining chairs, and reclining chairs incorporated in sectional sofas and the like) which offer even greater stability such that the ottoman or footrest can be extended and inclined at a greater angle to provide more comfort. In addition, a need exists for reclining chairs and motion seating furniture that offers a high degree of ease of operation and movement between various seating positions, even for persons who are larger than average. A need also exists for a robust and stable mechanism for a reclining chair that allows the user to recline the backrest without requiring the ottoman or footrest to be extended.

SUMMARY OF THE INVENTION

A mechanism for a reclining chair is caused to be more stable and to have enhanced ease of operation by having strut supports extending obliquely, forwardly and upwardly from pivotal connections to the base to a set of links connected to the operating handle torque tube, at the left and right sides. Preferably, the strut supports are located on each side of the base intermediate a forward support link and a rearward support link.

The principles of the invention will be further discussed with reference to the drawings wherein preferred embodiments are shown. The specifics illustrated in the drawings are intended to exemplify, rather than limit, aspects of the invention as defined in the claims.

The terms "left" and "right" as used to describe the sides of the mechanism or chair are used from viewpoint of a person occupying the chair. The "handle side" in the preferred embodiment is the right side of the chair. The term "inboard side" of a side linkage refers to the side viewed looking outwards from medially of the chair, and the term "outboard side" of a side linkage refers to the side viewed looking from outside towards the side mechanism.

In this description, the term longitudinal is used to denote the front-to-rear direction, and the term transverse is used to denote the left-to-right direction.

DETAILED DESCRIPTION OF PREFERED EMBODIMENTS

Figure 1:
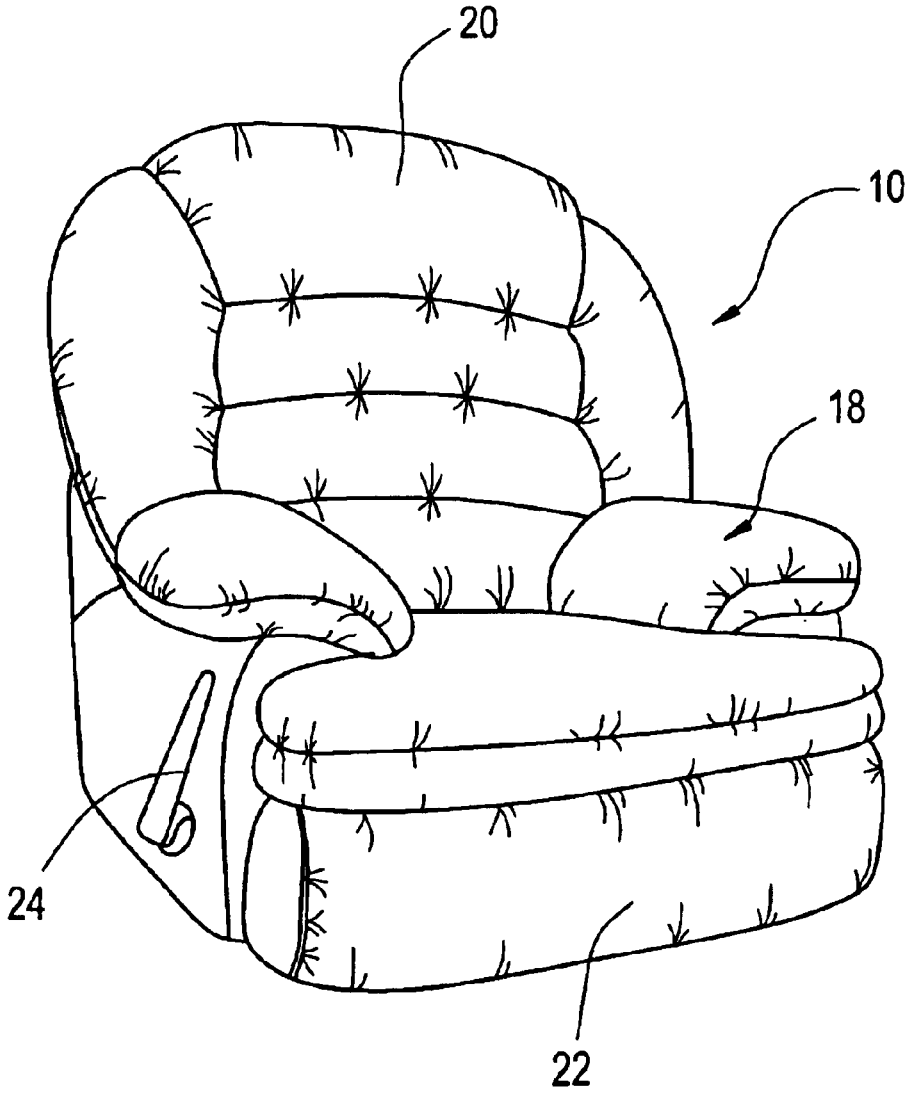
FIG. 1 is a perspective view of a reclining chair embodying principles of the present invention.

The chair 10 (FIG. 1) includes a base 12 (FIG. 2), a motion chair mechanism 14, an arm and seat frame mounting bracket 16, an upholstered seat and arm frame unit 18, an upholstered back 20 and an upholstered ottoman 22 (the primary member only of which shows in FIG. 1, the secondary member of which being stored therebehind in this position of the chair). (Ottomans are sometimes also known as leg rests or footrests.) In this embodiment, the operating mechanism is handle operated, at least for initiation of movement from the FIG. 2 to the FIG. 4 positions, the user-accessible operating handle being shown at 24 in FIG. 1 mounted on an end of a handle tube (to be described below, sometimes also known as a torque tube).

It is a convenient and conventional technique in the manufacture of reclining chairs, which is useful in manufacturing the chair 10, to provide the left and right sides of the base 12 and operating mechanism 14 (and, in this instance, the bracket 16) as corresponding elements of prefabricated mirror image (left and right) sub-assemblies often known as side linkages, certain corresponding elements of which are integrated by being interconnected by transverse interconnecting elements.

In a handle-operated motion chair, such as the preferred embodiment of the chair 10, the operating handle 24 is mounted on an extension 26 (through an opening through the upholstery of the seat and arm frame unit 18) of a transversely extending torque tube 28, opposite end portions of which are journaled in sleeve bearings 29, e.g., made of nylon or other self-lubricating synthetic plastic material, mounted in openings in respective links of the left and right side linkages.

In view of the mirror image nature of the left and right side linkages, only one is shown in FIGS. 2–5 and 7–8.

The base of the chair 10 could be more complex than the one shown; e.g., it could include a conventional swivel (suitably enlarged and strengthened). In the preferred embodiment, the base 12 is shown simply comprising left and right longitudinal members 30, each provided as an L-sectioned element having a lower, horizontal flange 32 and an upstanding outboard flange 34, laterally interconnected at the front and rear by transverse members 36, 38 each provided as an L-sectioned element having a lower, horizontal flange 40, and having an upstanding foremost flange 42 in the case front transverse member 36, and having an upstanding rearmost flange 44 in the case of the rear transverse member 38.

For lateral stability, the front and rear members 36, 38 can extend outboard somewhat beyond (e.g., two inches beyond) the longitudinal members 30. The front and rear, e.g., on these extensions, can be provided with downwardly facing floor glides 46, so that the chair 10 can be pushed along the floor to move it occasionally for cleaning under it, or for repositioning it, without marring the floor.

The members 30 are preferably bolted to the members 36 and 38 where they cross and, thus, are vertically juxtaposed.

The seat and arm frame mounting bracket 16 includes left and right longitudinal members 48, each provided as an L-sectioned element having an upper flange 50 located in a seating plane which is tilted up towards the front and down towards the rear from horizontal, and an outboard vertical flange 52.

The longitudinal members 48 of the bracket 16 are laterally interconnected at the front and rear by transverse members 54 and 56, each provided as an L-sectioned element having an upper flange 58 located in the aforementioned seating plane, and having a depending rearmost flange (not shown). The rear transverse member 56 is shown extending outboard of the longitudinal members 48, e.g., by about 4.5 inches at each rear corner, in order to provide cantilevered sites for mounting correspondingly wide portions of the seat and arm frame unit 18 on the bracket 16. Interconnections at corners of the bracket can be provided by nut-and-bolt assemblies installed through respective seating plane flanges where these cross.

Each side linkage of the mechanism 14 includes a main plate 60 which is longitudinally elongated, disposed in a respective vertical plane, and is generally concave upwards as seen in side elevation. Each main plate 60 is fixed near its front and rear, top ends, on the outboard sides of the vertical flanges 52 of the longitudinal members 48 of the bracket 16. (The plates 60 thus could be made integral with the respective members 48.)

The bearings 29 are provided in openings provided transversely through the main plates 60 intermediate the front and rear ends of the main plates 60, below the flanges 50 of the left and right longitudinal members of the bracket 16.

A transverse member 62, e.g., provided as a square-sectioned steel tube, offset downwards between the two members 48 (so as to avoid interfering with downward travel to the upholstered seat as a user sits down in the chair 10), is bolted at its opposite ends to respective tabs (not shown) formed on each main plate 60.

As is conventional, the ottoman is mounted on left and right pantograph linkage sets which form respective parts of the left and right side linkages. Each of these is shown including forward, middle and rear first links 64, 66 and 68, and forward, middle and rear second links 70, 72 and 74.

Describing one side, the upper, forward ends of the links 64 and 66 are connected by transverse, horizontal axis pivot joints 76, 78 to the vertical, longitudinal flange 80 of a primary ottoman mounting bracket 82, which also has a medially directed flange 84, to which a respective lateral end of the primary ottoman 22 is bolted.

A medially directed flange 86 is bent from the upper end of the link 70, to which a respective end of a secondary ottoman (not shown) is bolted.

The link 70 is connected by upper, middle and lower transverse, horizontal axis pivot joints 88, 90 and 92, respectively to the upper end of link 68, and an intermediate site on link 66 and the lower end of link 64.

The link 72 is connected by upper, middle and lower transverse, horizontal axis pivot joints 94, 96 and 98, respectively to the main plate 60 above and forwardly of the transverse member 62, an intermediate site on link 68 and the lower end of link 66.

The link 74 is connected by upper and lower transverse, horizontal axis pivot joints 100, 102, respectively to the main plate 60 below and rearwardly of the transverse member 62, and the lower end of link 68.

Outboard of the main plates 60, the left and right side linkages have respective crank links 104 bolted onto the torque tube 28 so as to each project radially from the torque tube in a respective vertical plane. Near its radially outer end, each crank link 104 is connected by a transverse, horizontal axis pivot joint 106 to the rear, lower end of a respective downwardly concave (in side elevation) driving link 108, the forward end of which is connected by a transverse, horizontal axis pivot joint 110 to an intermediate site on the respective pantograph link 74.

Figure 2:
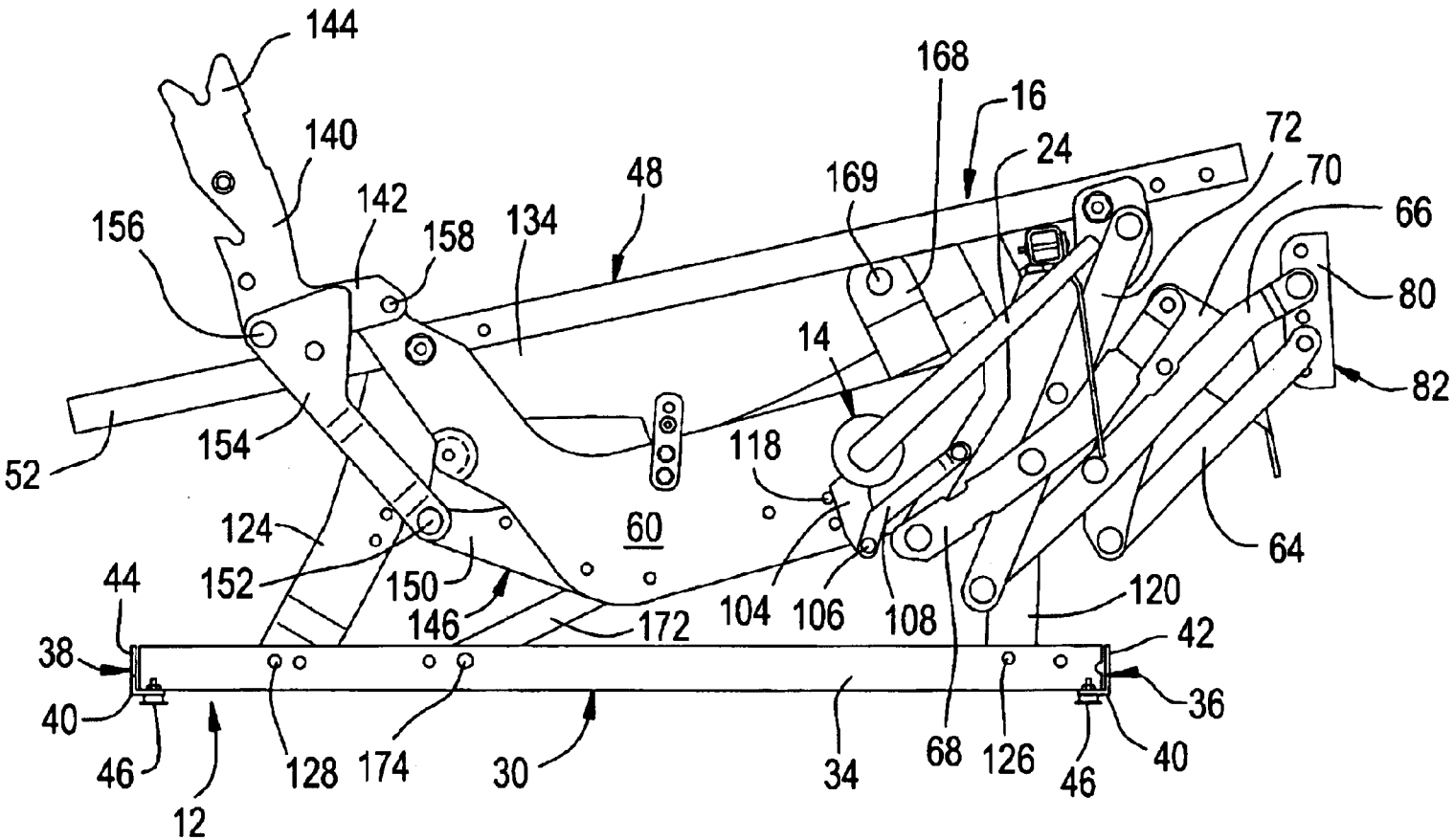
FIG. 2 is a side elevational view of the mechanism for the chair of FIG. 1 (right side linkage), shown in the fully erect position thereof.
Figure 3:
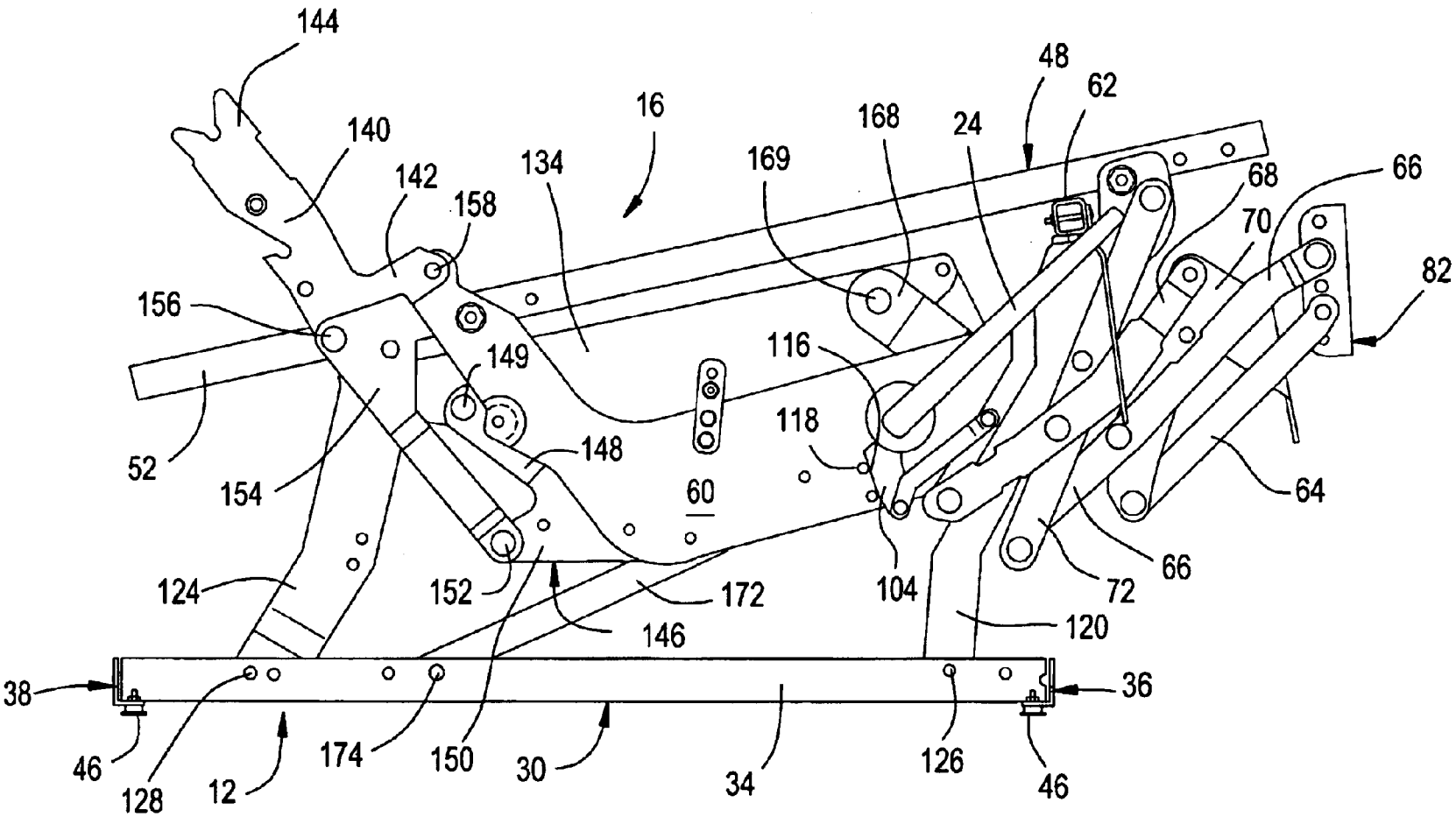
FIG. 3 is a comparable side elevational view of the mechanism shown with the backrest reclined and the ottoman in the retracted position thereof.
Figure 4:
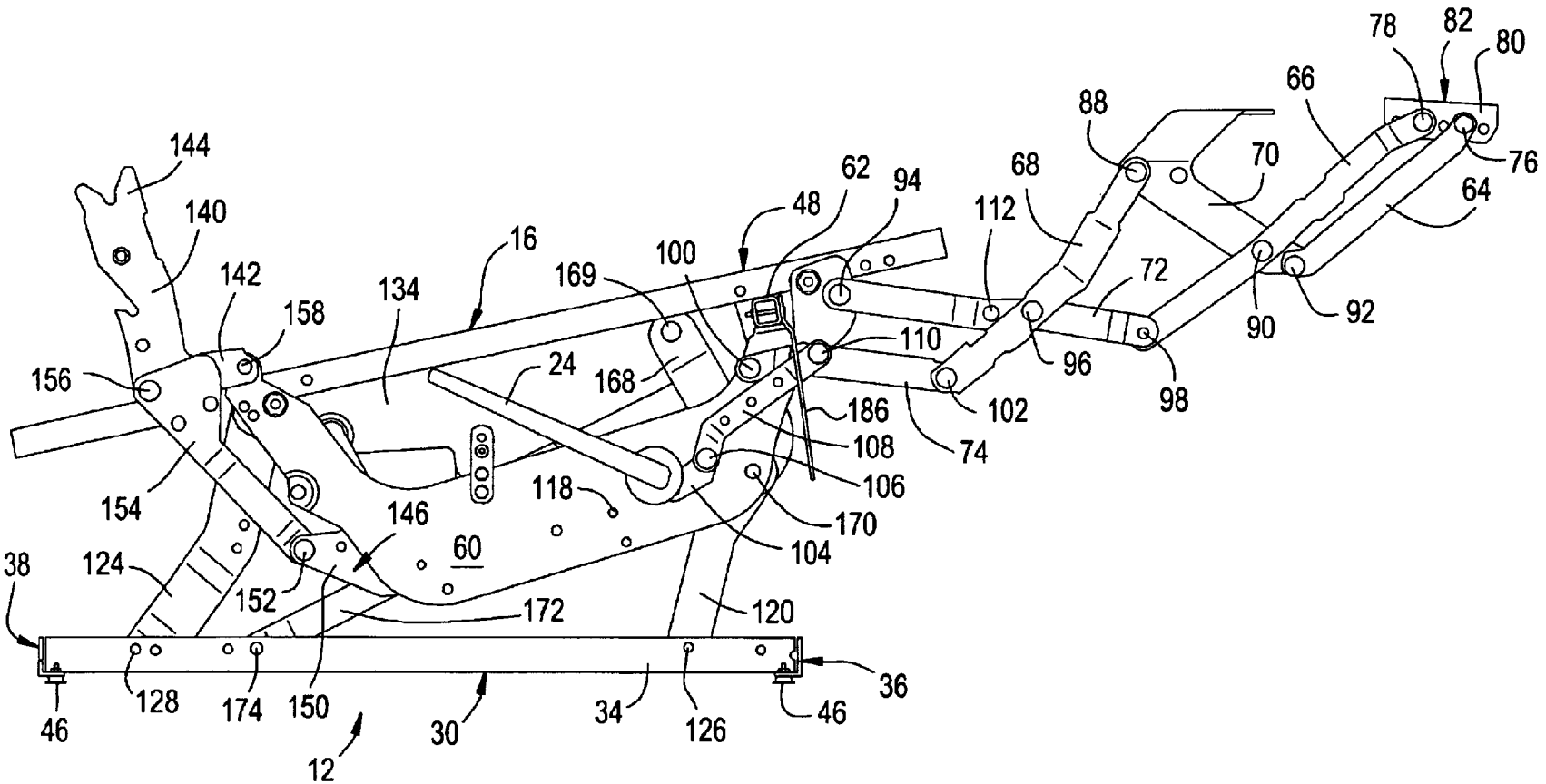
FIG. 4, is a comparable side elevational view of the mechanism, shown in the TV position thereof, with the backrest upright and the ottoman extended.
Figure 5:
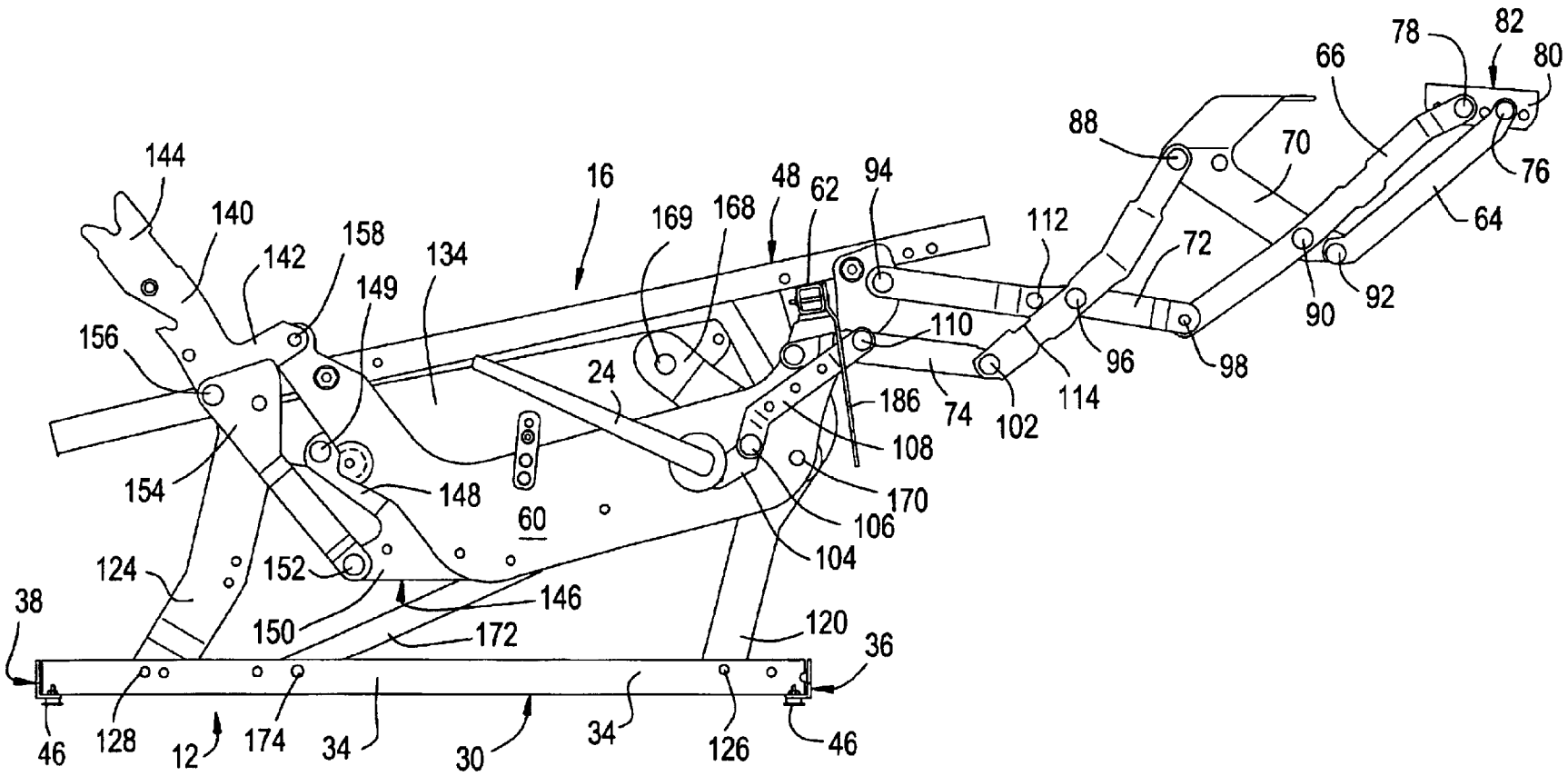
FIG. 5 is a comparable side elevational view of the mechanism, shown in the fully reclined position thereof.
Figure 6:
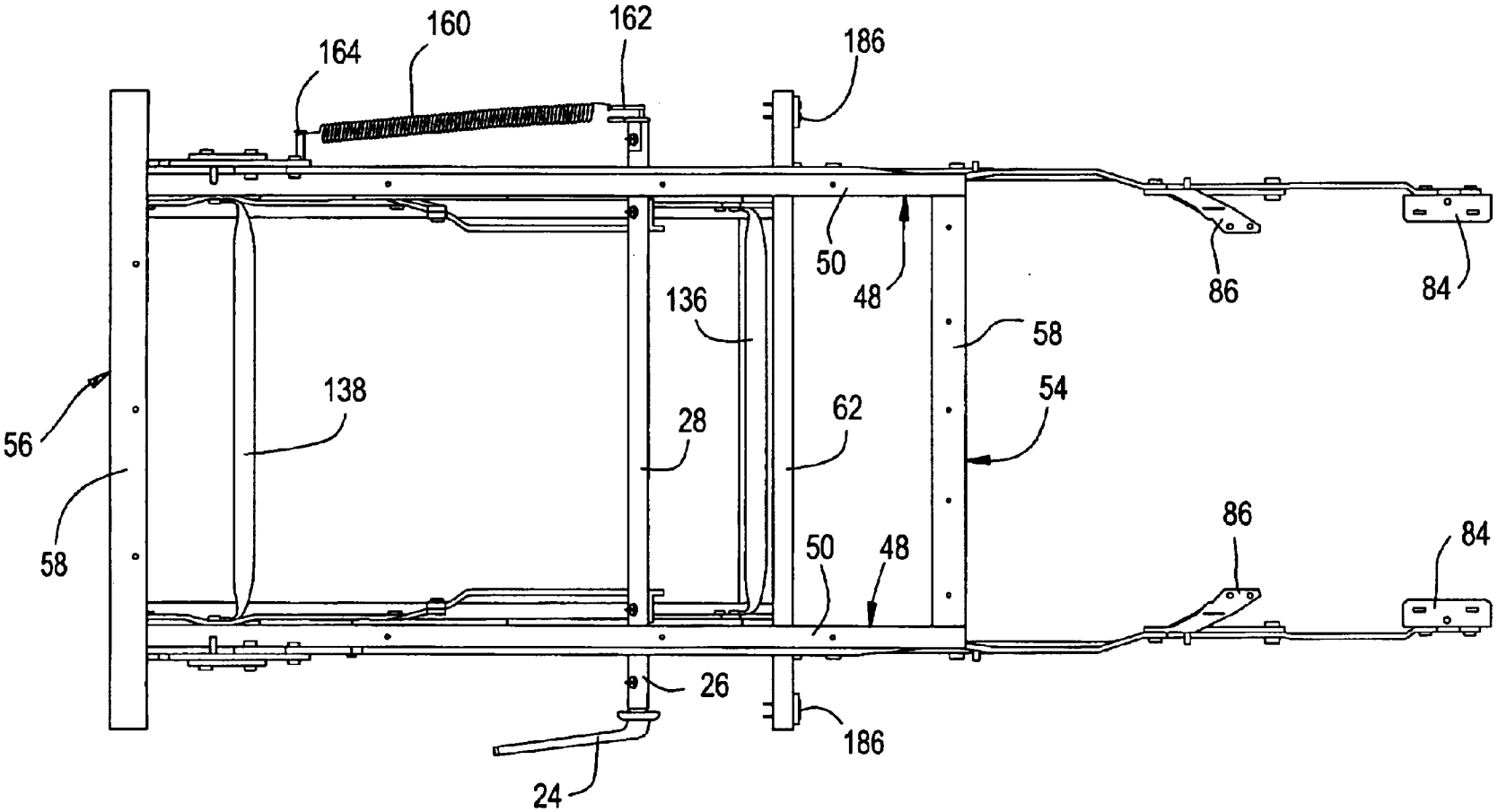
FIG. 6 is a top plan view of the mechanism, shown in the TV position thereof.
Figure 7:
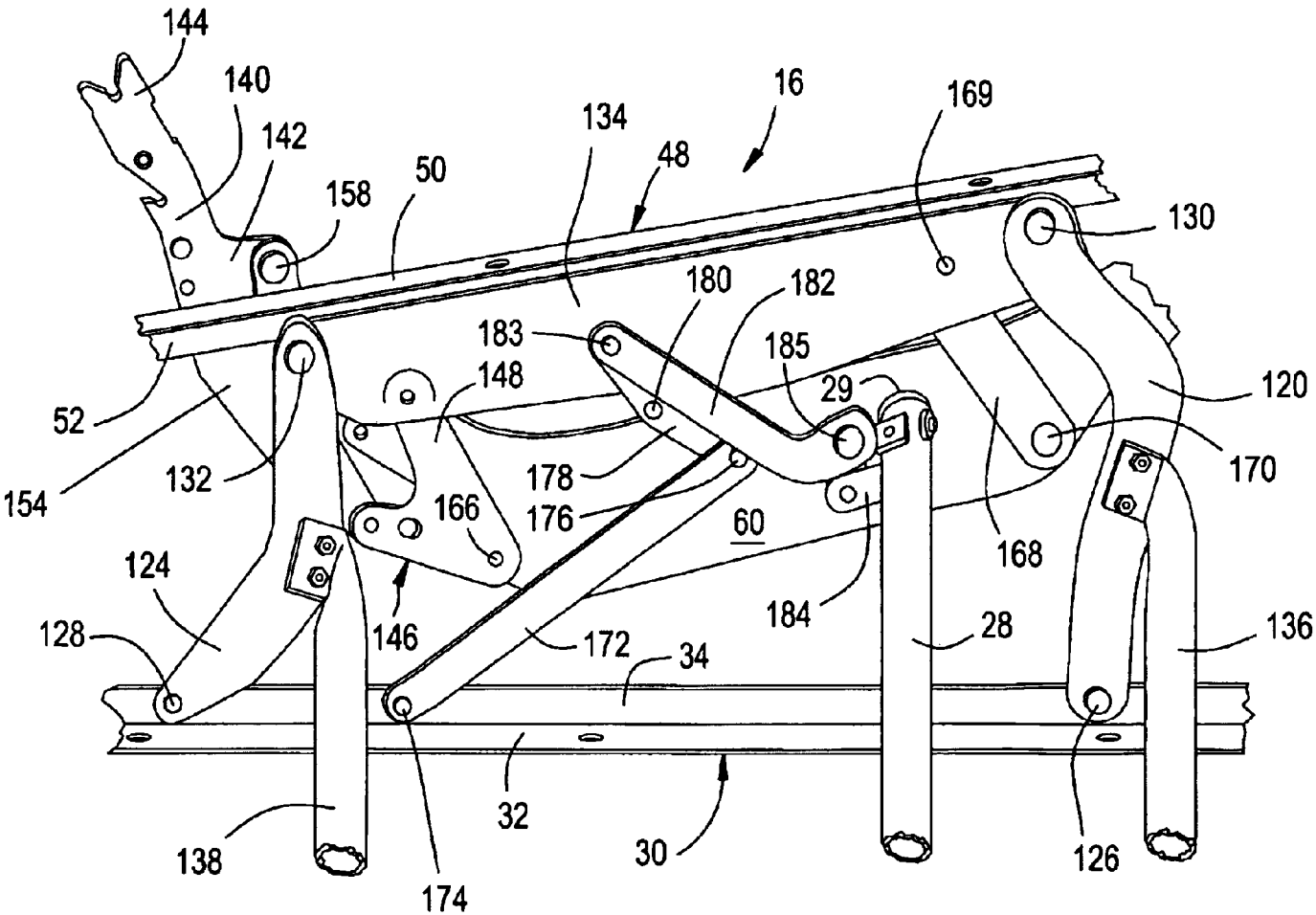
FIG. 7 is a fragmentary left, inboard perspective view of the mechanism in the fully erect position thereof.
Figure 8:
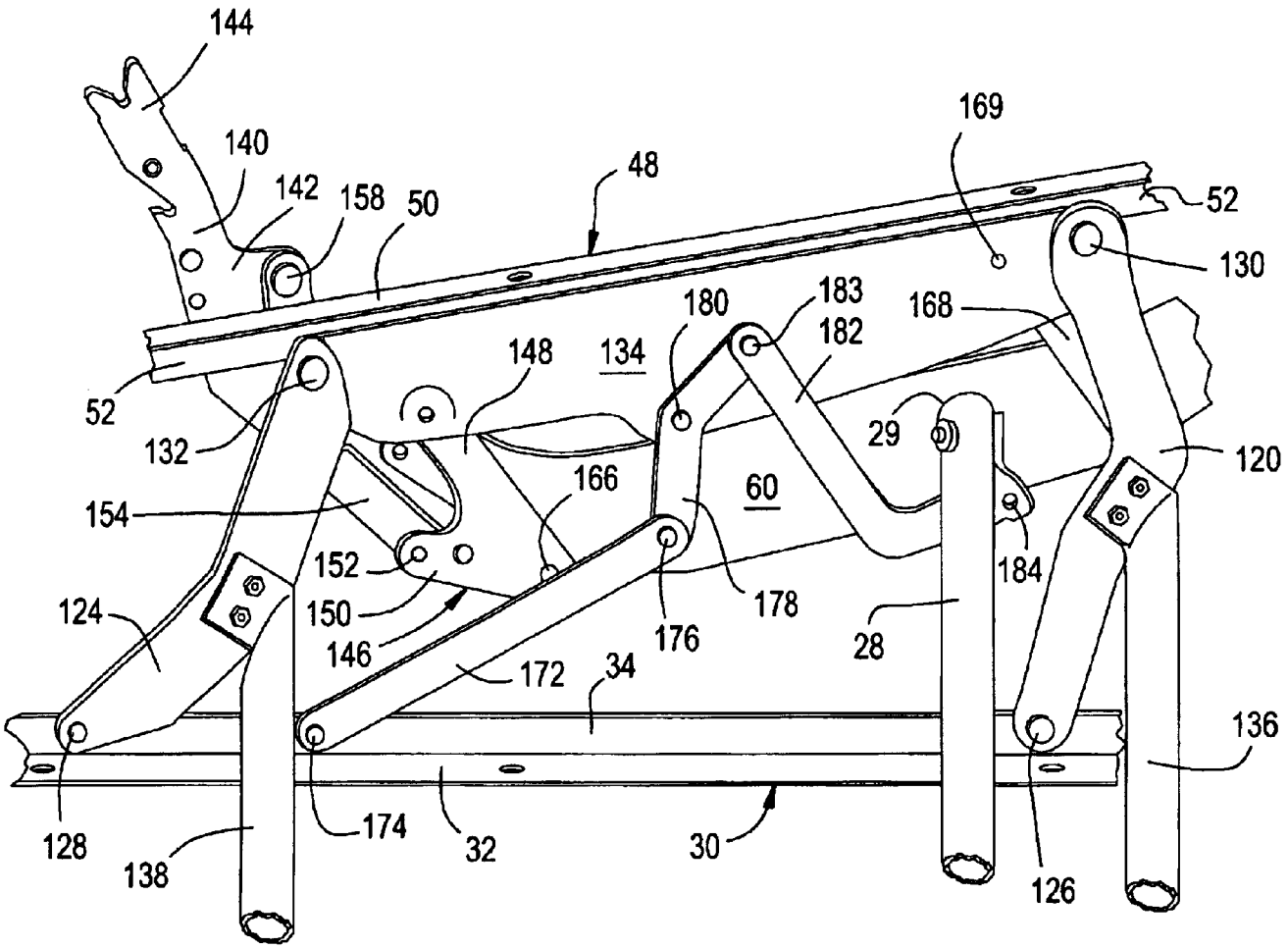
FIG. 8 is a fragmentary left inboard perspective view of the mechanism in the TV position thereof.

Accordingly, rotating the operating handle 24 over top dead center to the rear causes the pantographic linkages to extend the ottoman and secondary ottoman from the stowed position shown in FIGS. 1, 2 and 3, to the raised and extended position shown in FIGS. 4 and 5.

Reverting to single-side description, engagement of a laterally outwardly projecting pin 112, provided on the outside of the link 72 at an intermediate location, with the upper, rear side edge at a lower-intermediate site 114 on the link 68 stops extension of the pantographic linkage sets.

Conversely, engagement of an upper edge of a site 116 on the crank link 104 with a laterally outwardly directed pin 118 mounted on the outboard side of the main plate 60 stops retraction of the pantographic linkage sets.

A tension coil spring (not shown) can be stretched between and hooked at opposite ends to an eye (not shown) provided on the transverse member 62, outboard of the main plate 60, and a laterally outwardly directed pin (not shown) fixed on the driving link 108 at the intermediate, lower elbow of the latter, to become less stretched with extension of the pantographic linkage set, and more stretched with retraction of the pantographic linkage set, for preventing forward drooping of the ottoman when the chair is in its FIGS. 1 and 2, fully erect position.

Each side linkage further includes a forward upstanding support link 120 and a rear upstanding support link 124 having respective lower ends connected by transverse, horizontal axis pivot joints 126 and 128 to forward and rear sites on the vertical flange 34 of the longitudinal member 30 of the base 12.

The upper ends of the support links 120 and 124 are connected by respective transverse, horizontal axis pivot joints 130, 132 respectively to the forward and rear ends of a longitudinal link 134.

Transversely extending side linkage interconnecting members 136 and 138 are respectively bolted at opposite ends to intermediate sites on the forward and rear support links 120 and 124.

The side linkages further include interpivoted links for causing the seat and arm frame unit and the pantograph linkage-supported ottoman and secondary ottoman to move forwardly and upwardly, as a whole, along an oblique-to-horizontal path as the chair back is caused to recline (by a user leaning back with emphasis on the upper part of the chair back 20 while seated in the chair, to move the chair from its FIG. 2 to its FIG. 3 position (or from its FIG. 4 to FIG. 5 position), and for causing the reverse, as the person concentrates their weight downwards on the rear part of the upholstered seat of the upholstered seat and arm frame unit, while reducing backward pressure on the chair back, thereby, for example, moving the chair from its FIG. 5 fully reclined position, back to its FIG. 4 TV position.

These interpivoted links, on each side linkage, are shown including an L-shaped chair back mounting link 140, having a forwardly projecting lower leg 142 and an upwardly projecting leg 144.

A forwardly and downwardly pointing V-shaped link 146 has an upper leg 148 and a lower leg 150. The rear end of the upper leg 148 is pivotally connected by a transverse, horizontal axis pivot joint 149 to a location on the longitudinal link 134. The rear end of the lower leg 150 is pivotally connected by a transverse, horizontal axis pivot joint 152, to the lower, forward end of a connecting link 154, the upper, rear end of which is connected by a transverse, horizontal axis pivot joint 152 to a site at the lower, rear leg juncture (apex) of the L-shaped link 140.

The chair back 20, at its left and right sides, bolts to the legs 144 of the L-shaped links 140.

The forward end of the forwardly projecting lower leg 142 of each L-shaped link 140 is connected by a respective transverse, horizontal axis pivot joint 158 to an upwardly, rearwardly projecting tab at the upper rear of the main plate 60, above the upper flange 50 of the member 48 of the bracket 16. In the FIGS. 2 and 3 positions of the mechanism, the pivot joints 158 are approximately aligned with the pivot joints 132, transversely of the chair.

A compression coil spring 160, which elastically stretches as the chair is moved from its FIG. 4 to its FIG. 5 position, and recovers as the chair moves back to its FIG. 4 position, has its opposite ends hooked over laterally outwardly projecting pins 162, 164.

As the chair back is reclined, the seat and arm frame unit moves forward relative to the base, and the seating plane raises as the V-shaped links 146 pivot about horizontal axis pivot joints 149 on their upper legs 148.

The trajectory of the bracket 16 upon movement from the TV position to the fully reclined position, and back, is constrained for each side linkage by a link 168 which projects downwardly and forwardly, having its upper end pivotally connected to a forward location on the longitudinal link 134 by the pivot joint 169, and its lower end pivotally connected to a forward location on the main plate 60, by a pivot joint 170.

The chair occupant is additionally supported by strut links 172 which extend upwardly and forwardly from lower end transverse horizontal axis pivot joints 174 provided on the flanges 34 of the longitudinal members 30 of the base 12 at a location intermediate the rear upstanding support link 124 and the forward upstanding support link 120 on each side, to upper end transverse horizontal axis pivot joints 176 connected to pivot links 178 at lower ends thereof. The pivot links 178 on each side linkage are pivotally mounted at an intermediate position along their length on the respective longitudinal links 134 by pivot joints 180, and the upper ends of the pivot links 178 are pivotally joined to connecting links 182 by pivot joints 183. The connecting links 182 are in turn pivotally joined by pivot joints 185 to crank links 184 which are secured to the torque tube 28.

Figure 9:
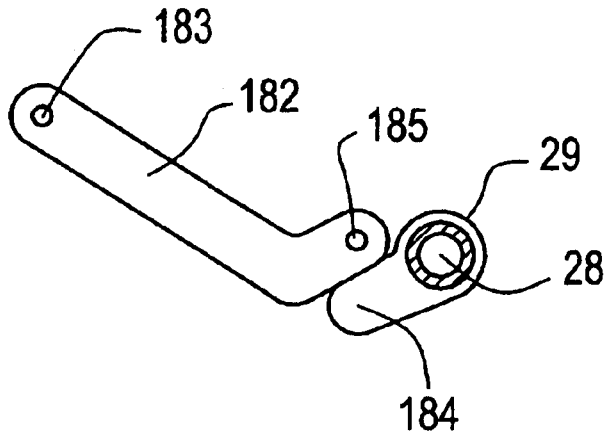
FIG. 9 is a diagrammatic fragmentary view of a portion of the mechanism in the fully erect position thereof.
Figure 10:
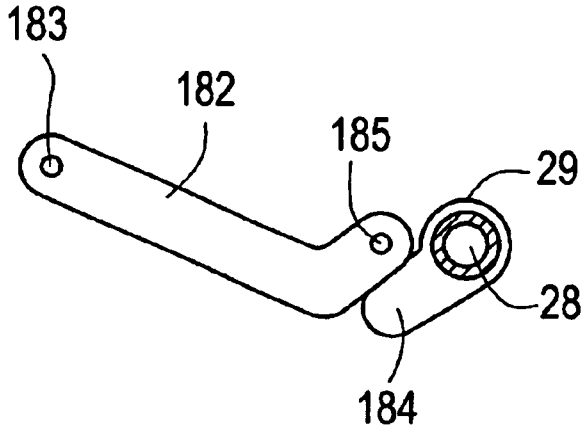
FIG. 10 is a diagrammatic fragmentary view of a portion of the mechanism in the backrest reclined/ottoman retracted position thereof.

The strut links 172 and the additional links joining them to the torque tube 28 permit an occupant of the chair 10 to recline the back 20 to a position of increased comfort without requiring the ottoman 22 to be extended (permitting movement from the position of FIG. 2 to that of FIG. 3). The links 172, 178, 182, and 184 are connected to the torque tube 28, but permit the back 20 to be reclined without causing significant rotation of the torque tube 28 (which would extend the ottoman 22). For example, in the erect position of FIG. 2, the torque tube 28, pivot joint 185 and pivot joint 183 are all generally aligned (as diagrammatically depicted in FIG. 9), and this arrangement allows reclining of the back, which causes forward movement of the main plate 60 and the torque tube 28, to occur without causing rotation of the torque tube 28 nor extension of the ottoman 22. FIG. 10 diagrammatically depicts the generally aligned positions of the torque tube 28, pivot joint 185 and pivot joint 183 when the chair is in the position of FIG. 3 with back reclined and ottoman not extended.

The links 172, 178, 182, and 184 also assist in guiding and constraining movement of the main plates 60, and provide enhanced stability and ease of operation of the chair. The resulting enhanced stability and guidance of movement of the main plates 60 allows the ottoman 22 to reach a position at a greater angle from the horizontal (or "pitch") when in the extended position of FIG. 4 and FIG. 5.

The upholstered seat and arm frame unit 18 can be provided with a wide range of styles. In the preferred embodiment, it bolts to front and rear transverse members 54, 56 of the mounting bracket 16, and to laterally outwardly projecting depending flanges 186 which are bolted to cantilevered outrigger stubs of the transverse member 62.

The mechanism for the chair 10 is preferably made of conventional materials, e.g., steel plate, punched, bent, bored and painted flat black; steel pins; self-lubricated plastic washer-like bushings for joints, steel rivet-type pivot joints, attention being given to thickness and strength, given that the chair 10 in its preferred embodiment is suitable for use by especially tall and heavy users.

However, the support struts and other features of the mechanism may be provided on motion chairs intended for use by average-sized persons as well.

The principles of the invention have been shown and explained in relation to a free-standing, single seat chair having two arms. However, the principles of the invention can be applied to motion seating furniture in which the upholstered seat and arm frame is one-armed (as in a recliner unit for an armed end of a multiple seat sectional sofa), or is replaced by an armless upholstered seat frame (as in a recliner unit for an armless end of a multiple seat sectional sofa).

It should now be apparent that the reclining chair and mechanism therefor as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A mechanism for a reclining chair which includes an upholstered seat frame, an upholstered back, and an ottoman, comprising:

a base arranged to be supported on a floor;

left and right side linkages each including:

a set of pantographically interpivoted links for mounting the ottoman for extension to an extended position and retraction to a retracted position;

a set of interpivoted support links for supporting the upholstered seat frame relative to the base; and a set of interpivoted support links for supporting the upholstered back for movement between a more erect position achievable when the ottoman is in the retracted or extended position, and a more recumbent position achievable when the ottoman is in the retracted or extended position;

a plurality of transverse members fixedly interconnecting a plurality of corresponding links of said left and right side linkages;

a transversely extending torque tube journaled in said left and right side linkages for reversible rotation about its own longitudinal axis;

interpivoted crank and driving links operatively connecting said torque tube with said pantographically interpivoted links, for extending the ottoman upon rotation of the torque tube in one angular direction and for retracting the ottoman upon rotation of the torque tube in an opposite angular direction;

at least one strut which extends upwardly and forwardly from a single pivotal connection to said base to a single pivotal connection to a set of interpivoted links connected to said torque tube, each said strut being arranged to provide support from said base to a user when seated in the chair, when the ottoman is extended and retracted and is being extended and retracted, when the upholstered seat frame in the erect and TV positions, and is being moved between the erect and TV positions, and the upholstered back is in the more erect and more recumbent positions, and is being moved between the more erect and more recumbent positions.

2. The mechanism of claim 1, wherein:

said each set of interpivoted support links for supporting the upholstered seat frame relative to the base includes a forward support link and a rearward support link, and said single pivotal connection of said at least one said strut to said base is located intermediate one of said forward support links and one of said rearward support links.

3. The mechanism of claim 1, wherein:

said set of interpivoted links connected to said torque tube includes a pivot link pivotally connected to said strut at one end, pivotally connected to a connecting link at another end, and being pivotally mounted at an intermediate location along its length, said connecting link being pivotally connected to a crank link connected to said torque tube.

4. The mechanism of claim 1, wherein:

said set of interpivoted support links includes left and right longitudinal members of a rectangular support bracket for the upholstered seat frame; and said plurality of transverse members includes forward and rear members of said rectangular support bracket, rigidly joined at respective corners to said left and right longitudinal members of said rectangular support bracket.

5. The mechanism of claim 4, wherein:

at least one forwardly located one of said transverse members and at least one rearwardly located one of said transverse members extend both leftwardly and rightwardly laterally outwardly beyond said left and right longitudinal members of said rectangular support bracket to provide cantilevered mounting sites for securement of the upholstered seat frame thereto.

6. A reclining chair, comprising:

an upholstered seat frame;

an upholstered back;

an ottoman;

a base arranged to be supported on a floor;

a mechanism including:

left and right side linkages each including:

a set of pantographically interpivoted links mounting the ottoman for extension to an extended position and retraction to a retracted position;

a set of interpivoted support links supporting the upholstered seat frame relative to the base; and a set of interpivoted support links supporting the upholstered back for movement between a more erect position achievable when the ottoman is in said retracted or extended position, and more recumbent position which is achievable when the ottoman is in said retracted or extended position;

a plurality of transverse members fixedly interconnecting a plurality of corresponding links of said left and right side linkages;

a transversely extending torque tube journaled in said left and right side linkages for reversible rotation about its own longitudinal axis;

interpivoted crank and driving links operatively connecting said torque tube with said pantographically interpivoted links, for extending the ottoman upon rotation of the torque tube in one angular direction and for retracting the ottoman upon rotation of the torque tube in an opposite angular direction; and at least one strut which extends upwardly and forwardly from a single pivotal connection to said base to a single pivotal connection to a set of interpivoted links pivotally connected to said torque tube; each said strut being arranged to provide support from said base to a user when seated in the chair when the ottoman is extended and retracted and is being extended and retracted, when the upholstered seat frame is in the erect and TV positions, and is being moved between the erect and TV positions, and the upholstered back is in the more erect and more recumbent positions, and is being moved between the more erect and more recumbent positions.

7. The reclining chair of claim 6, wherein:

said each set of interpivoted support links supporting the upholstered seat frame includes a forward support link and a rearward support link, and said single pivotal connection of said strut to said base is located intermediate one of said forward support links and one of said rearward support links.

8. The reclining chair of claim 6, wherein:

said set of interpivoted links connected to said torque tube includes a pivot link pivotally connected to said strut at one end, pivotally connected to a connecting link at another end, and being pivotally mounted at an intermediate location along its length, said connecting link being pivotally connected to a crank link connected to said torque tube.

9. The reclining chair of claim 6, wherein:

one said strut link is associated with said left side linkage, and another said strut link is associated with said right side linkage.

10. The reclining chair of claim 9, wherein:

at least one forwardly located one of said transverse members and at least one rearwardly located one of said transverse members extend both leftwardly and rightwardly laterally outwardly beyond said left and right longitudinal members of said rectangular support bracket to provide cantilevered mounting sites for securement of the upholstered seat frame thereto.

11. The reclining chair of claim 6, wherein:

said set of interpivoted support links includes left and right longitudinal members of a rectangular support bracket for the upholstered seat frame; and said plurality of transverse members includes forward and rear members of said rectangular support bracket, rigidly joined at respective corners to said left and right longitudinal members of said rectangular support bracket.

* * * * *